US006637523B2

(12) United States Patent
Lee et al.

(10) Patent No.: US 6,637,523 B2
(45) Date of Patent: Oct. 28, 2003

(54) DRILLING PROCESS MONITOR

(75) Inventors: Chack Fan Lee, Hong Kong (HK); Kum Tim Law, Cumberland (CA); Zhong Qi Yue, Middle Levels (HK)

(73) Assignee: The University of Hong Kong, Hong Kong (HK)

( * ) Notice: Subject to any disclaimer, the term of this patent is extended or adjusted under 35 U.S.C. 154(b) by 50 days.

(21) Appl. No.: 09/943,592

(22) Filed: Aug. 30, 2001

(65) Prior Publication Data

US 2002/0074165 A1 Jun. 20, 2002

Related U.S. Application Data

(60) Provisional application No. 60/234,535, filed on Sep. 22, 2000.

(51) Int. Cl.[7] ..... E21B 7/04

(52) U.S. Cl. ..... 175/27; 175/48; 702/9

(58) Field of Search ..... 175/27, 40, 48; 702/9; 340/853.3

(56) References Cited

U.S. PATENT DOCUMENTS

| | | | | |
|---|---|---|---|---|
| 5,237,539 A | * | 8/1993 | Selman | 367/69 |
| 6,233,498 B1 | * | 5/2001 | King et al. | 700/174 |
| 6,233,524 B1 | | 5/2001 | Harrell et al. | 702/9 |
| 2001/0045300 A1 | * | 11/2001 | Fincher et al. | 175/26 |

OTHER PUBLICATIONS

Gui, M.W. et al., "Instrumented borehole drilling using ENPASOL system," pp. 1–5. (undated prior art).

Colosimo, Paulo, "On the use of drilling parameters in rock foundations," Geotechnical Site Characterization, Robertson & Mayne (eds) © 1998 Balkema, Rotterdam, pp.347–352.

Tani, Kazuo, "Importance of instrumental drilling," Geotechnical Site Characterization, Robertson & Mayne (eds) ™ 1998 Baulkema, Rotterdam, pp. 431–437.

Nishi, K., "Estimation of soil resistance using rotary percussion drill," Geotechnical Site Characterization, Robertson & Mayne (eds) ™ 1998 Balkema, Rotterdam, pp. 393–398.

(List continued on next page.)

*Primary Examiner*—William Neuder
(74) *Attorney, Agent, or Firm*—Jones Day

(57) ABSTRACT

An apparatus is used with a drilling assembly for drilling a borehole. The drilling assembly has an impact device linked to a drill head. The impact device is powered by a first fluid under a first pressure to impart a percussive force to the drill head. The percussive force is a function of the first pressure. A thruster of the drilling assembly is also linked to the drill head. The thruster is powered by a second fluid under a second pressure to impart a thrust force to the drill head. The thrust force is a function of the second pressure. Additionally, a rotator of the drilling assembly is linked to the drill head. The rotator is powered by a third fluid under a third pressure to impart a torque to the drill head. The torque is a function of the third pressure. The apparatus includes a first pressure sensor communicating with the first fluid to output a first electrical signal that is a function of the first pressure. A second pressure sensor communicates with the second fluid to output a second electrical signal that is a function of the second pressure. A third pressure sensor communicates with the third fluid to output a third electrical signal that is a function of the third pressure. A position sensor outputs a fourth electrical signal that is a function of depth of the drill head relative to a reference location. A device monitors the first, second, third and fourth signals. The device produces respective graph traces of functions of the percussive force, the thrust force, the torque and the depth.

8 Claims, 5 Drawing Sheets

OTHER PUBLICATIONS

Garassino, A.L. et al., "Detection of cavities by monitored borehole drilling (TMD)," Geotechnical Site Charactertization, Robertson & Mayne (eds) © 1998 Balkema, Rotterdam, pp. 365–370.

Pfister, Paul, "Recording drilling parameters in ground engineering," Ground Engineering, Apr. 1985 (pp. 16–21) and corresponding title page of journal.

Fortunati, Fabio et al., "The use of electronics in the management of site investigation and soil improvement works: principles and applications," Geotechnical Site Characterization, Robertson & Mayne (eds) © 1998 Balkema, Rotterdam, pp. 359–363.

* cited by examiner

DRILLING PROCESS MONITOR

This application claims the benefit of U.S. Provisional Application No. 60/234,535, filed Sep. 22, 2000, and incorporates the Provisional Application by reference.

FIELD OF THE INVENTION

The present invention relates to systems for drilling holes in the ground.

BACKGROUND

In a drilling operation, a drilling assembly is used to drill a hole in the earth. It is sometimes desirable to monitor the progress of the drilling operation.

SUMMARY OF THE INVENTION

An apparatus is used with a drilling assembly for drilling a borehole. The drilling assembly has a drill head. An impact device of the drilling assembly is linked to the drill head. The impact device is powered by a first fluid under a first pressure to impart a percussive force to the drill head. The percussive force is a function of the first pressure. A thruster of the drilling assembly is also linked to the drill head. The thruster is powered by a second fluid under a second pressure to impart a thrust force to the drill head. The thrust force is a function of the second pressure. Additionally, a rotator of the drilling assembly is linked to the drill head. The rotator is powered by a third fluid under a third pressure to impart a torque to the drill head. The torque is a function of the third pressure. The apparatus includes a first pressure sensor communicating with the first fluid to output a first electrical signal that is a function of the first pressure. A second pressure sensor communicates with the second fluid to output a second electrical signal that is a function of the second pressure. A third pressure sensor communicates with the third fluid to output a third electrical signal that is a function of the third pressure. A position sensor outputs a fourth electrical signal that is a function of depth of the drill head relative to a reference location. A device monitors the first, second, third and fourth signals. The device produces respective graph traces of functions of the percussive force, the thrust force, the torque and the depth.

In a preferred embodiment, the device produces the graph traces in real time during the drilling operation. The first, second and third electrical signals are analog signals. The fourth electrical signal is a digital signal. The graph traces are indicative of the occurrence of downward drilling, drilling stoppage, raising of the drill head, and addition of drilling rods.

DESCRIPTION

Figure 1:
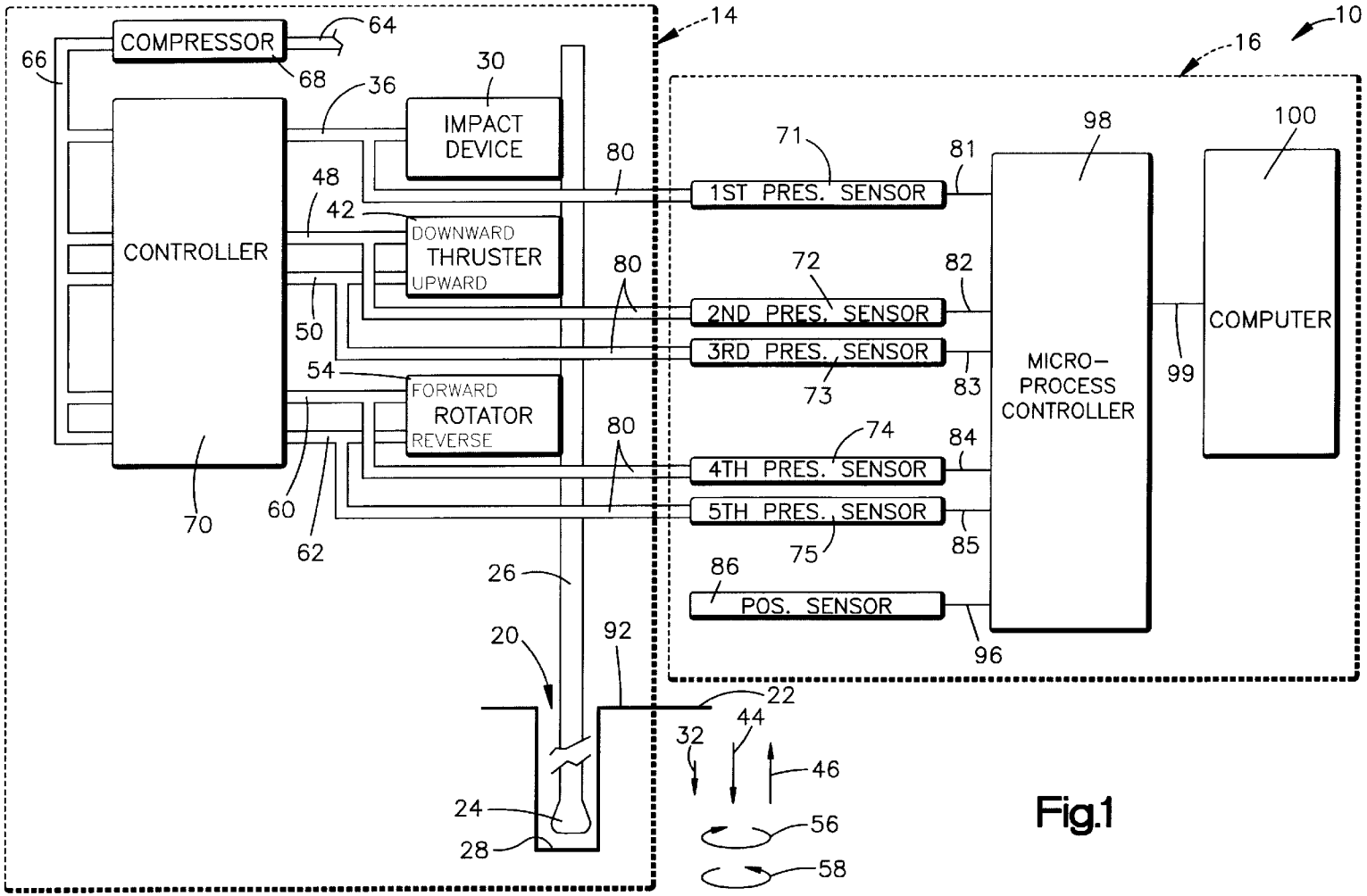
FIG. 1 is a schematic view of a drilling system according to the present invention.

An example of a preferred embodiment of the present invention is shown schematically in FIG. 1. The preferred embodiment is a drilling system 10 that includes a drilling assembly 14 and a monitoring system 16. The drilling assembly 14 performs a drilling operation defined by drilling a borehole 20 in the earth 22. The monitoring system 16 measures and displays dynamic parameters related to the drilling operation.

In this embodiment, the drilling assembly 14 is a pneumatic percussive rotary drilling machine. The drilling assembly 14 has a drill head 24 at the end of a drill string 26 defined by a series of drilling rods. During the drilling operation, the drill head 24 rotates and vibrates while being thrust into the bottom end 28 of the borehole 20.

The drill head 24 is linked to an impact device 30 in a known manner. The impact device 30 applies a percussive force, indicated by arrow 32, which is transmitted through the drill string 26 to the drill head 24 to fragment soil and drive the drill head 24 into the bottom end 28 of the borehole 20. The impact device 30 is powered by a first fluid 36 under a first pressure. The percussive force at the drill head 24 is a function of the first pressure.

The drill head 24 is also linked to a thruster 42. The thruster 42 can apply a downward force, indicated by arrow 44, that is transmitted through the drill string 26 to the drill head 24 to thrust the drill head 24 into the earth 22. The thruster 42 can also apply an upward force, indicated by arrow 46, that is transmitted through the drill string 26 to the drill head 24 to raise the drill head 24. The thruster 42 is powered by a second fluid 48 under a second pressure and a third fluid 50 under a third pressure. The downward force is a function of the second pressure. The upward force is a function of the third pressure.

The drill head 24 is further linked to a rotator 54. The rotator 54 can apply a forward torque, indicated by arrow 56, that is transmitted through the drill string 26 to the drill head 24 to rotate the drill head 24 in a forward direction. Rotation of the drill head 24 in the forward direction causes the drill head 24 to abrade, and to be driven downward through, the bottom end 28 of the borehole 20. The rotator 54 can also apply a reverse torque, indicated by arrow 58, that is transmitted through the drill string 26 to the drill head 24. Rotation of the drill head 24 in the reverse direction assists in removing the drill head 24 from the bottom end 28 of the borehole 20. The rotator 54 is powered in the forward direction by a fourth fluid 60 under a fourth pressure. The rotator 54 is powered in the reverse direction by a fifth 62 fluid under a fifth pressure. The forward torque is a function of the fourth pressure. The reverse torque is a function of the fifth pressure.

In this embodiment, each of the first, second, third, fourth and fifth fluids 36, 48, 50, 60 and 62 is a gas. However, for use with hydraulic drilling assemblies, these fluids would be liquids. These fluids 36, 48, 50, 60 and 62 are compressed from a common fluid supply 64 into a manifold 66 by a compressor 68 and are delivered to the corresponding devices 30, 42 and 54. Delivery of each of these fluids 36, 48, 50, 60 and 62 to the respective device 30, 42 and 54 is controlled by a controller 70.

The monitoring system 16 includes five individual pressure sensors 71, 72, 73, 74 and 75 for measuring the pressure of the five fluids 36, 48, 50, 60 and 62, respectively. The pressure sensors 71, 72, 73, 74 and 75 are in communication with the respective fluids 36, 48, 50, 60 and 62 through fluid lines 80. The pressure of each fluid 36, 48, 50, 60 and 62 is conducted through the respective fluid line 80 to the respective pressure sensor 71, 72, 73, 74 and 75. Each pressure sensor 71, 72, 73, 74 and 75 produces an analog electrical signal that is a function of the pressure of the respective fluid 36, 48, 50, 60 and 62. The signals are output onto respective electrical lines 81, 82, 83, 84 and 85.

A position sensor 86 is operative to measure the depth of the drill head 24 relative to a reference location. The reference location is a fixed location 92 on the surface of the earth 22. Alternatively, the reference location can be a fixed location (not shown) on the drilling assembly 14. The depth measurement may be accomplished in any suitable manner known in the art. The position sensor 86 produces a digital signal representing a value that is a function of the depth of the drill head 24. The digital signal is output on an electrical line 96.

The five analog signals and the one digital signal are communicated over the lines 81, 82, 83, 84, 85 and 96 to a micro-processor controller 98. The micro-process controller 98 converts the five analog signals and the one digital signal to six corresponding digital data typically in RS232 format. The micro-process controller 98 functions as a data buffer to manipulate the data and change data format. The micro-process controller 98 also controls the data collection of the six electrical signals in real time simultaneously via the six lines 81, 82, 83, 84, 85 and 96. The micro-process controller 98 can continuously store the digital data on a disk drive (not shown) in real time.

In the present embodiment, the micro-process controller 98 outputs the digital data over an electrical line 99 to a computer 100, which in the present embodiment is a personal computer. During the drilling operation, the computer 100 continuously stores the digital signals on a disk drive (not shown) in real time and can continuously produce graphs of the respective digital signals in real time. Each graph is displayed on a suitable medium, such as a sheet of paper.

Figure 8:
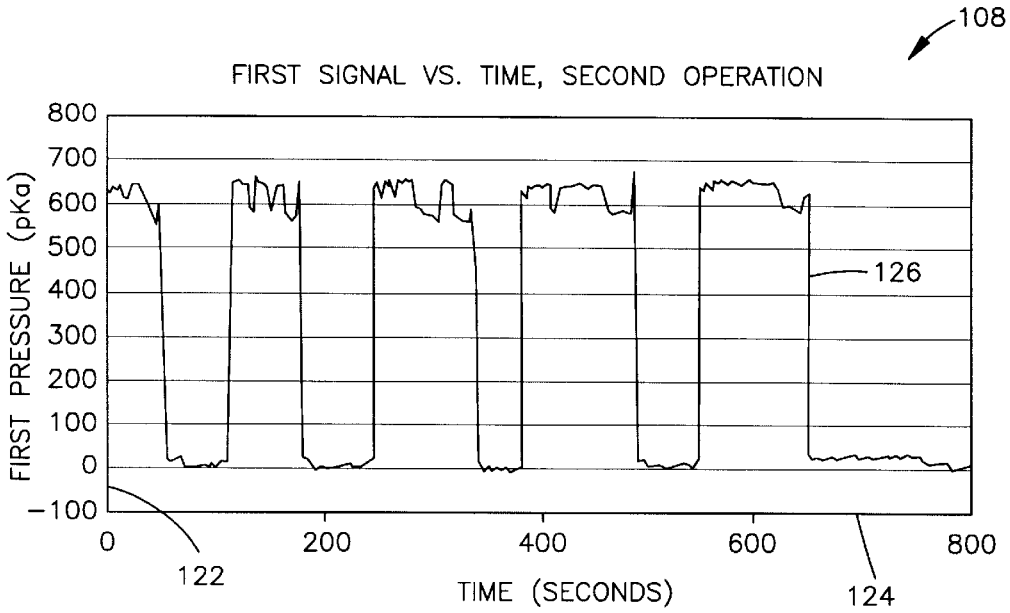
Figure 9:
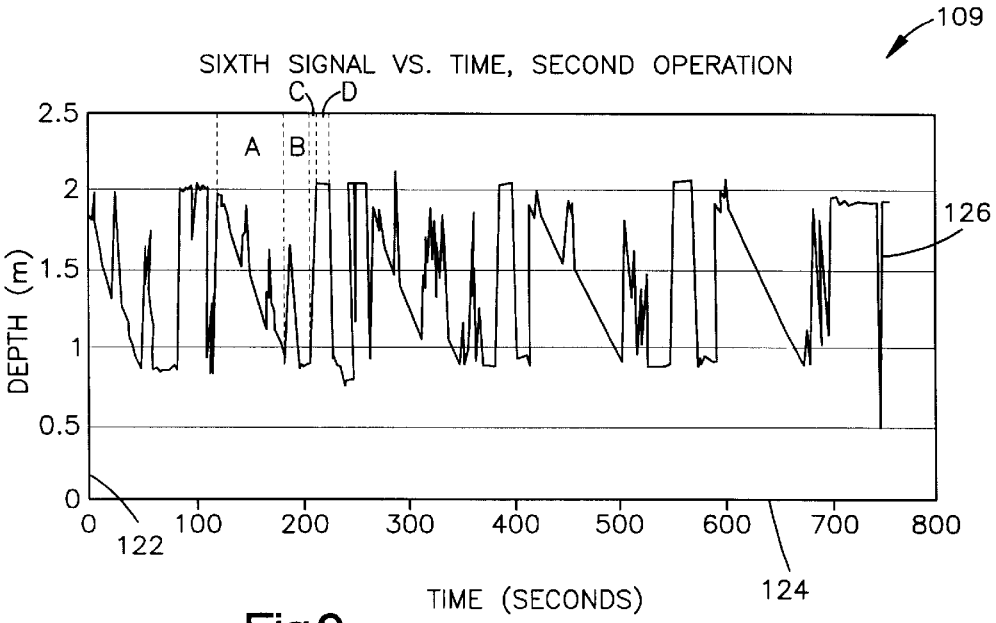

FIGS. 2–7 show graphs 102, 103, 104, 105, 106 and 107 corresponding to the first, second, third, fourth, fifth and sixth digital signals, respectively, for a first typical drilling operation. FIGS. 8 and 9 show graphs 108 and 109 corresponding to the first and sixth signals, respectively, for a second typical drilling operation.

The graphs 102, 103, 104, 105, 106, 107, 108 and 109 in FIGS. 2–9 have many features in common. These features can be explained with reference to the graph 102 of FIG. 2. Graph 102 includes a vertical axis 122 representing signal magnitude. The vertical axis 122 is graduated in terms of pressure in units of kPa. A horizontal axis 124 represents elapsed time relative to a start time designated as zero. The horizontal axis 124 is graduated in units of seconds. Graph 102 also includes a trace 126 based on the first digital signal corresponding to percussive force. The vertical position of each point along the trace 126 is a function of the first pressure at the time that point was measured.

Figure 3:
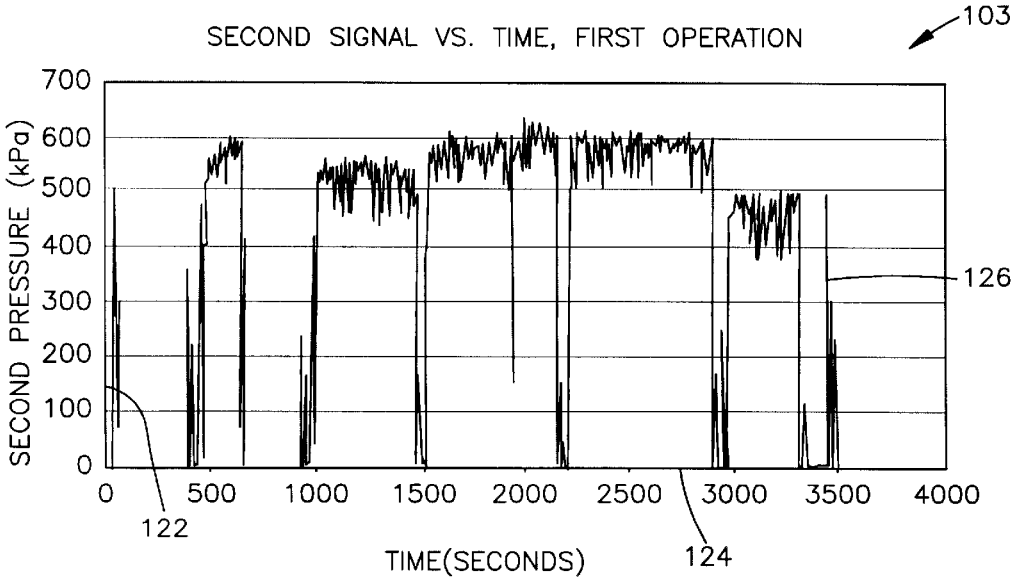
Figure 4:
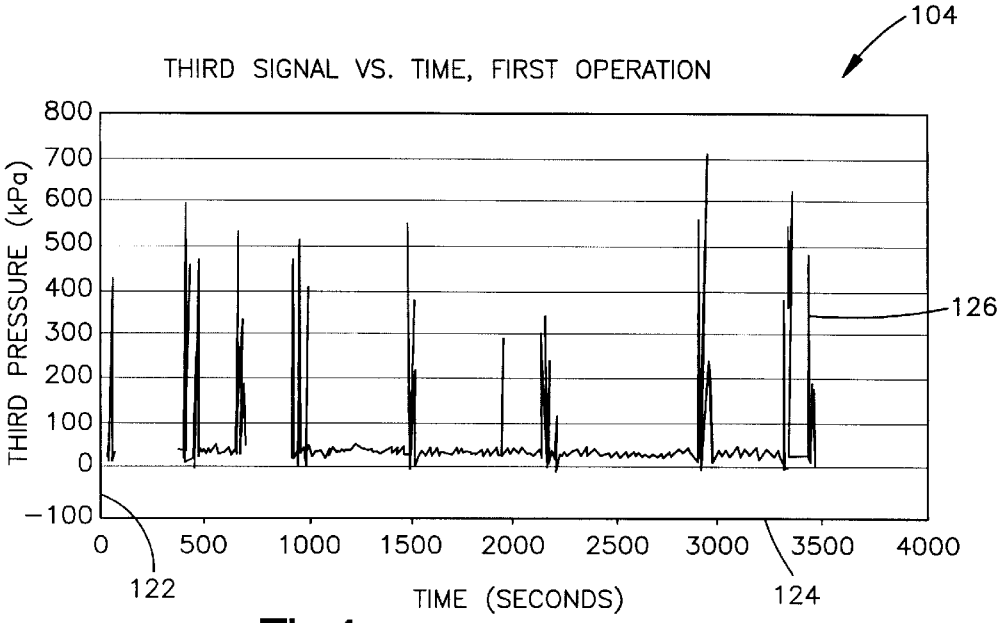
Figure 5:
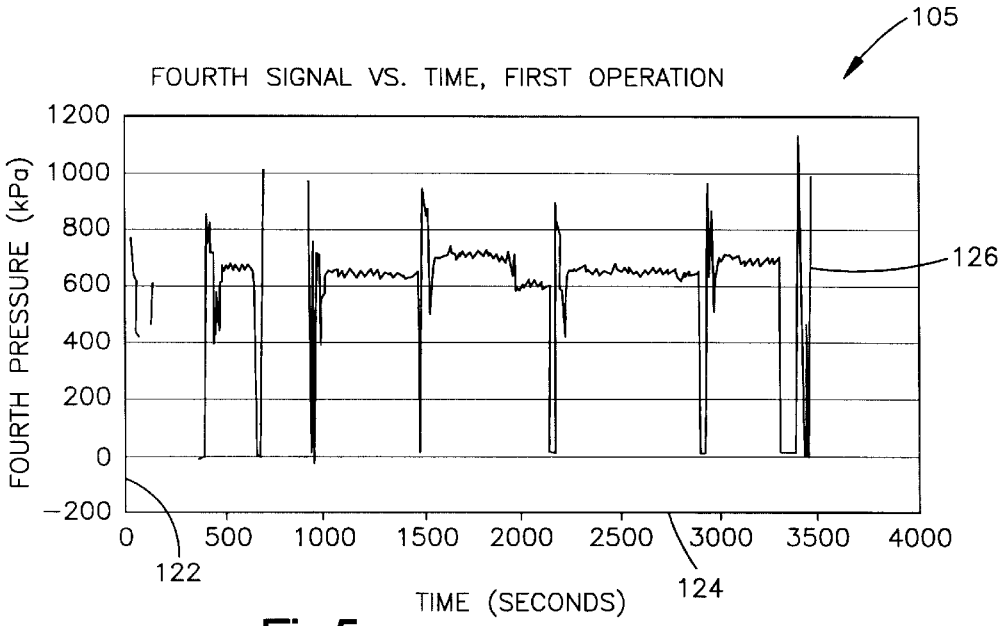
Figure 6:
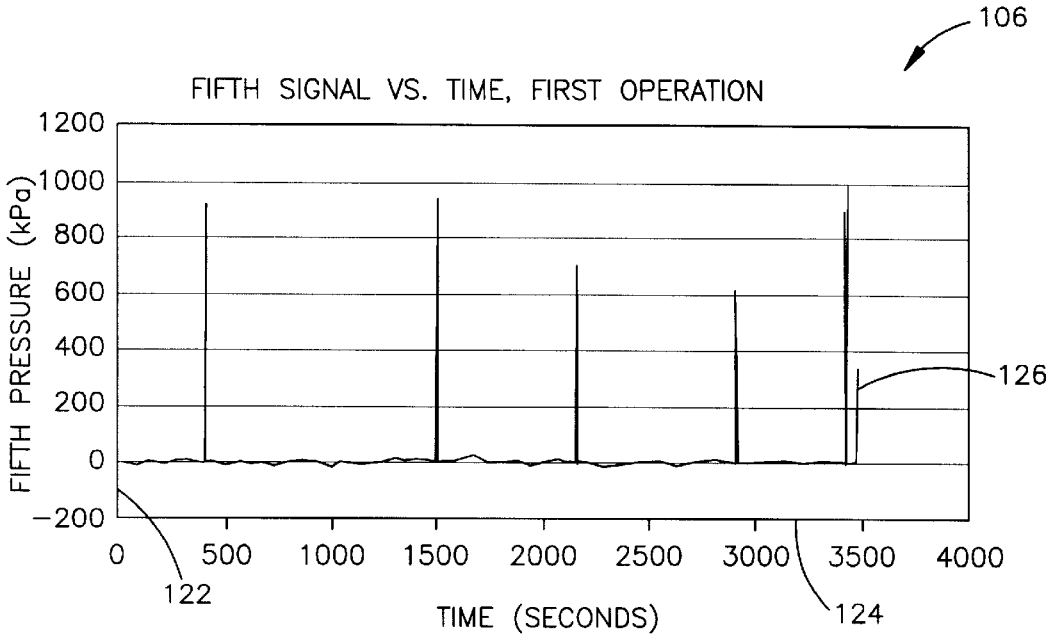

In graph 103 of FIG. 3, the trace 126 is based on the second digital signal. The trace 126 is thus a function of the second pressure, corresponding to downward thrust. Similarly, the trace 126 of the graph 104 of FIG. 4 is based on the third digital signal and is therefore a function of the third pressure, corresponding to upward thrust. Likewise, the trace 126 of the graph 105 of FIG. 5 is based on the fourth digital signal. It is consequently a function of the fourth pressure, corresponding to forward torque. The trace 126 of the graph 106 of FIG. 6 is based on the fifth digital signal. It is thus a function of the fifth pressure, corresponding to reverse torque.

Figure 7:
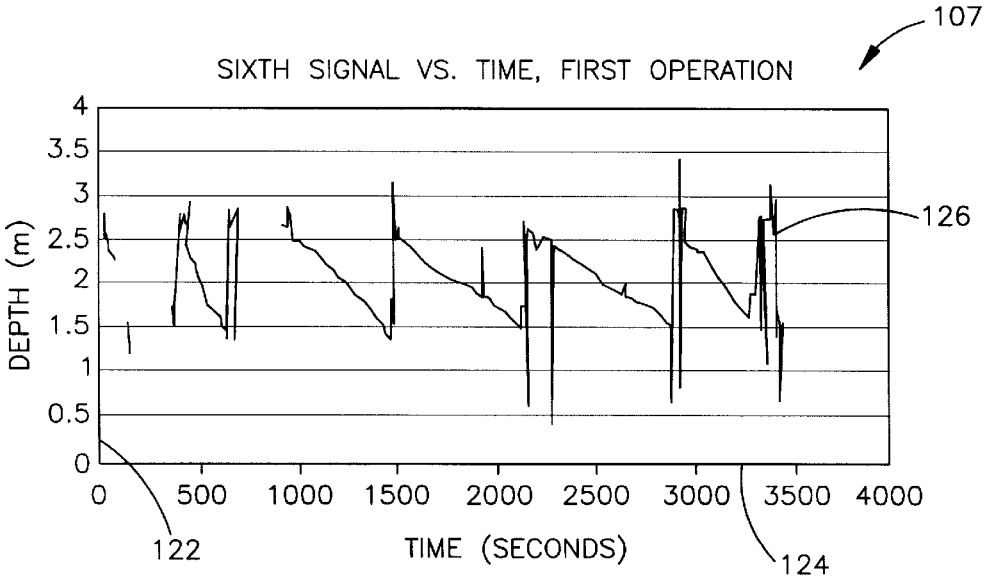

In graph 107 of FIG. 7, the vertical axis 122 is graduated in terms of depth in units of meters. This is in contrast to the graphs 102, 103, 104, 105 and 106 (FIGS. 2–6, respectively) in which the vertical axes 122 are graduated in terms of pressure. In graph 107 of FIG. 7, the trace 126 is based on the sixth digital signal. The vertical position of each point along the trace 126 is consequently a function of depth of the drill head 24 (FIG. 1) at the time that point was measured.

Figure 2:
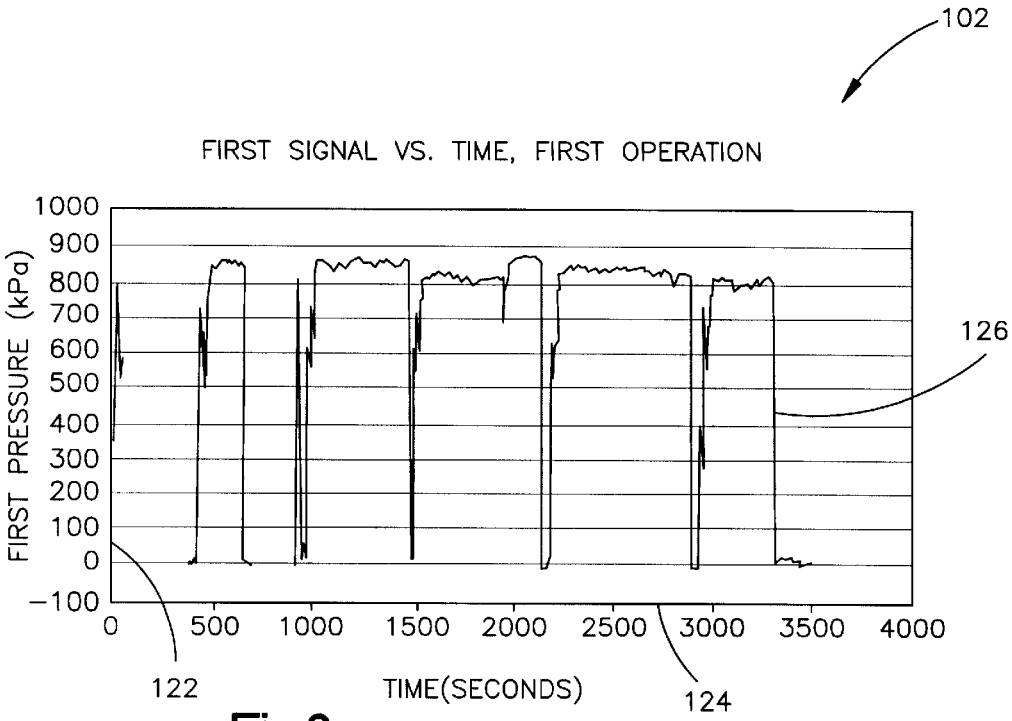
FIGS. 2–9 are graphs produced by the drilling system of FIG. 1.

The graph 108 of FIG. 8 is similar to the graph 102 of FIG. 2, but is for the second drilling operation. Likewise, the graph 109 of FIG. 9 is similar to the graph 107 of FIG. 7, but is for the second drilling operation.

In this embodiment, the traces 126 are plotted on separate graphs 102, 103, 104, 105, 106, 107, 108 and 109 (FIGS. 2–9), each having a separate horizontal axis 124. However, the horizontal axes 124 of graphs relating to the same operation are the same in size and in time scale. For example, the horizontal axes 124 of the graphs in FIGS. 2–7 all have the same time scale, 0–4000 seconds.

During and after the drilling operation, an operator can interpret the graphs shown in FIGS. 2–9 to assess the progress of the drilling operation, to note any irregularity in the operation, and to discern the subsurface profile and properties. The operator can also interpret these graphs to determine when different operations have been performed. For example, referring to graph 109 in FIG. 9, section A corresponds to downward drilling, section B corresponds to drilling stoppage, section C corresponds to raising of the drill head 124, and section D corresponds to addition of drilling rods.

The invention has been described with reference to preferred embodiments. Those skilled in the art will perceive improvements, changes and modifications. Such improvements, changes and modifications are intended to be within the scope of the claims.

We claim:

1. An apparatus for use with a drilling assembly for drilling a borehole, the drilling assembly having:

a drill head;

an impact device linked to the drill head, the impact device being powered by a first fluid under a first pressure to impart a percussive force to the drill head, the percussive force being a function of the first pressure;

a thruster linked to the drill head, the thruster being powered by a second fluid under a second pressure to impart a thrust force to the drill head, the thrust force being a function of the second pressure; and a rotator linked to the drill head, the rotator being powered by a third fluid under a third pressure to impart a torque to the drill head, the torque being a function of the third pressure;

said apparatus comprising:

a first pressure sensor communicating with the first fluid to output a first electrical signal that is a function of the first pressure;

a second pressure sensor communicating with the second fluid to output a second electrical signal that is a function of the second pressure;

a third pressure sensor communicating with the third fluid to output a third electrical signal that is a function of the third pressure;

a position sensor that outputs a fourth electrical signal that is a function of depth of the drill head relative to a reference location; and a device that monitors said first, second, third and fourth signals, and that produces respective graph traces of functions of the percussive force, the thrust force, the torque and the depth.

2. The apparatus of claim 1 wherein said device produces said graph traces in real time during a drilling operation.

3. The apparatus of claim 1 wherein said first, second and third electrical signals are analog signals.

4. The apparatus of claim 1 wherein said fourth electrical signal is a digital signal.

5. The apparatus of claim 1 wherein said graph traces are indicative of the occurrences of downward drilling, drilling stoppage, raising of the drill head, and addition of drilling rods.

6. The apparatus of claim 1 wherein each of the first, second and third fluids is a gas.

7. The apparatus of claim 1 wherein the thrust force is a downward thrust force, and the thruster is powered also by a fourth fluid under a fourth pressure to impart an upward thrust force to the drill head, the upward thrust force being a function of the fourth pressure, and said apparatus further comprises a fourth pressure sensor that outputs a fifth electrical signal that is a function of the fourth pressure.

8. The apparatus of claim 1 wherein the torque is a forward torque, and the rotator is powered also by a fourth fluid under a fourth pressure to impart a reverse torque to the drill head, the reverse torque being a function of the fourth pressure, and said apparatus further comprises a fourth pressure sensor that outputs a fifth electrical signal that is a function of the fourth pressure.

* * * * *